US006810842B2

(12) United States Patent
Itou

(10) Patent No.: US 6,810,842 B2
(45) Date of Patent: Nov. 2, 2004

(54) OIL CONTROL VALVE AND INSTALLING METHOD THEREOF

(75) Inventor: Takayuki Itou, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 158 days.

(21) Appl. No.: 10/182,797

(22) PCT Filed: Dec. 4, 2000

(86) PCT No.: PCT/JP00/08560

§ 371 (c)(1),
(2), (4) Date: Aug. 2, 2002

(87) PCT Pub. No.: WO02/46583

PCT Pub. Date: Jun. 13, 2002

(65) Prior Publication Data

US 2004/0025819 A1 Feb. 12, 2004

(51) Int. Cl.[7] ..... F01L 1/34

(52) U.S. Cl. ..... 123/90.15; 123/90.12; 123/90.16; 123/90.17; 123/90.31; 123/195 C

(58) Field of Search ..... 123/90.12, 90.15, 123/90.16, 90.17, 90.18, 195 C, 198 F, 193.5, 193.3, 90.27, 90.31; 464/1, 2, 160

(56) References Cited

U.S. PATENT DOCUMENTS 5,067,450 A * 11/1991 Kano et al. ..... 123/90.17
6,129,060 A * 10/2000 Koda ..... 123/90.17

FOREIGN PATENT DOCUMENTS

JP 11-280541 10/1999

* cited by examiner

*Primary Examiner*—Thomas Denion
*Assistant Examiner*—Ching Chang
(74) *Attorney, Agent, or Firm*—Sughrue Mion, PLLC

(57) ABSTRACT

An oil control valve (60) that controls a valve timing gear mounted on a cylinder head (1) of an internal combustion engine. The oil control valve includes a housing (3) with plural oil lines; a spool type valve (5) that moves in the housing to open and close the oil lines; and a solenoid (31) having a metal case (33) and driving the spool type valve. And this housing (3) is mounted on the cylinder head (1). At least a part of the metal case (33) passes through a through hole (183) through a cylinder head cover (18) covering the cylinder head (1) and is disposed outside the cylinder head cover (18). As a result, all parts of the oil control valve (60) are disposed inside the head cover (18), and even in case of oil leakage, the oil does not leak out of the engine.

27 Claims, 13 Drawing Sheets

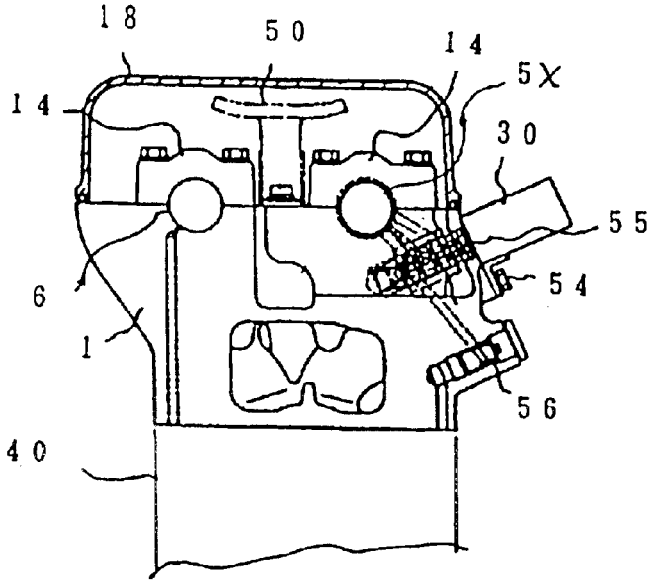
(PRIOR ART) FIG. 13
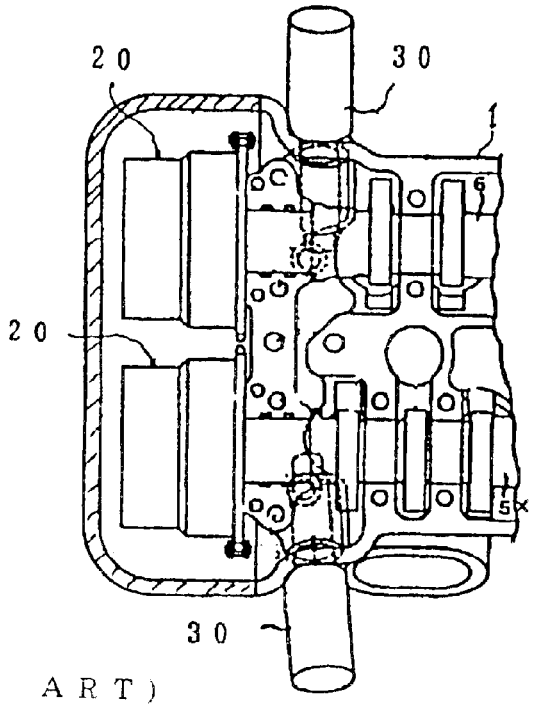
(PRIOR ART)
FIG. 14

OIL CONTROL VALVE AND INSTALLING METHOD THEREOF

FIELD OF THE INVENTION

The present invention relates to an improvement in an oil control valve (hereinafter referred to as OCV) for controlling a variable valve timing gear of an internal combustion engine and an installing method thereof.

BACKGROUND OF THE INVENTION

In the internal combustion engine, particularly in 4-cycle gasoline engine for vehicles, valve timing of at least one of intake and exhaust valves is controlled in order to improve performance of the engine. In a method generally employed for controlling the valve timing, a rotational phase with respect to a crankshaft of a so-called over head camshaft (hereinafter referred to as an OHC) mounted on an upper portion of the engine is hydraulically controlled by a variable valve timing gear (VVT) mounted on a shaft end of the OHC.

A valve that supplies a controlled hydraulic pressure to this VVT is the oil control valve (OCV).

In general, the OCV is a valve drive with a solenoid coil, which is installed in the vicinity of a bearing of the OHC of a cylinder head in order to form a hydraulic oil line on a wall of the cylinder head thereby shortening the hydraulic oil line.

FIGS. 13 and 14 show an OCV installed in an engine disclosed in the Japanese Patent Publication (unexamined) No. 280541/1999, for example. FIG. 13 is a view taken from a front part of the engine, and FIG. 14 is a view taken from an upper part of the engine.

In the drawings, reference numeral 1 is a cylinder head, numeral 18 is a cylinder head cover (hereinafter simply referred to as head cover) mounted on an upper portion of the cylinder head 1, numeral 5X is an intake camshaft disposed on the upper portion of the cylinder head 1, numeral 6 is an exhaust camshaft disposed in the same manner, numeral 14 is bearings (also called cam caps) rotatably holding the intake camshaft 5X and the exhaust camshaft 6.

Numeral 20 is a variable valve timing gear attached to one end of each camshaft 5X, 6, and numeral 30 is an oil control valve that supplies a controlled hydraulic pressure not shown to the variable valve timing gear 20. The oil control valve 30 is mounted on the cylinder head 1 by a fitting bolt 54, with an O-ring member 55 held between the oil control valve 30 and the cylinder head 1. Numeral 56 is an oil filter, and numeral 50 is a chain guide.

FIG. 15 is a detailed enlarged view showing the construction of the oil control valve OCV 30 in FIGS. 13 and 14. In the drawing, numeral 2 is an OCV installation hole provided in the cylinder head 1, and the OCV installation hole 2 has plural hydraulic oil lines 2*a* to 2*e*. Numeral 2*a* and 2*c* are drain lines, numeral 2*b* is an oil supply line, and numeral 2*d* and 2*e* are oil lines communicating to the variable valve timing gear 20.

Now, operation of the mentioned known art is described.

Numeral 3 is a housing inserted into the OCV installation hole 2, and plural partition walls are provided in the housing 3. Numeral 5 is a spool type valve that is inserted into the housing 3 and moves in axial direction according to whether or not a solenoid 31 is energized, and the spool type valve 5 is in contact with a drive shaft of the solenoid 31 by an urging force of a spring 4. As shown in the drawing, plural hydraulic oil lines are provided, and when the solenoid 31 is not energized, oil is supplied from the oil line 2*b* to 2*d*, oil in the oil line 2*e* is discharged to the oil line 2*c*, and a phase angle of the variable valve timing gear 20 is changed. On the other hand, when the solenoid 31 is energized, oil is supplied from the oil line 2*b* to the oil line 2*e*, oil in the oil line 2*d* is discharged to the 2*a*, the phase angle of the variable valve timing gear 20 is changed in a direction opposite to the foregoing direction. In the neutral state, oil supply from 2*b* to 2*d* and 2*e* is interrupted, oil discharge from 2*d* to 2*a* and from 2*e* to 2*c* is interrupted, and the phase angle of the variable valve timing gear 20 is held as it is.

Numeral 32 is a connector for energizing (applying a current to) the solenoid 31, and numeral 33 is a metal case forming a part of a magnetic circuit of the solenoid 31.

In order to prevent oil from leaking outside through an opening between a wall face of the OCV installation hole 2 and the housing 3, a first O-ring 54*a* is disposed between the wall face of the OCV installation hole 2 and the housing 3. A second O-ring 54*b* is disposed in order to prevent oil from leaking outside through an opening between the housing 3 and the case 33, and third O-rings 54*c* and 54*d* are disposed in order to prevent oil from leaking outside of the solenoid 31.

As shown in FIGS. 13 to 15, the OCV 30 has its oil line-switching portion (the housing 3 and the spool type valve 5) in the engine, but it is inevitable that the solenoid 31 and the connector 32 of the OVC 30 are disposed outside the engine for convenience of wiring.

As described above, the conventional oil control valve is installed with its solenoid portion protruding from an outer wall of the engine, and this worsens a space factor in engine room. Moreover, it is necessary to provide many oil lines in the cylinder head because of its installation structure.

The present invention was made to solve the above-discussed problems, and has an object of achieving an oil control valve in which the oil control valve protrudes less from the engine, has less oil lines, and has less oil leaks. Another object of the invention is to provide an installing method of such an oil control valve.

SUMMARY OF THE INVENTION

One object of the present invention is to achieve an oil control valve in which the oil control valve protrudes less from the engine, has less oil lines, and has less oil leaks. Another object of the invention is to provide an installing method of such an oil control valve.

An oil control valve according to the invention is to control a variable valve timing gear for adjusting operation timing of at least one of exhaust and intake camshafts mounted on a cylinder head of an internal combustion engine, and include a housing provided with plural oil lines and a spool type valve that moves in the mentioned housing to open and close the oil lines; and a solenoid having a metal case that forms a part of a magnetic circuit and driving the spool type valve.

And the housing is mounted on the cylinder head of the internal combustion engine, and at least a part of the metal case passing through a through hole provided through a cylinder head cover covering the cylinder head is disposed outside the cylinder head cover.

As a result of employing such a construction, even in case of oil leakage in the OCV, the oil leaks only within the cylinder head cover and does not leak outside, and therefore it is possible to simplify the structure of preventing oil from leaking outside the oil control valve.

And the housing is mounted on the cylinder head of the internal combustion engine, and at least a part of the metal case passing through a through hole provided through a cylinder head cover covering the cylinder head is disposed outside the cylinder head cover.

As a result of employing such a construction, even in case of oil leakage in the OCV, the oil leaks only within the cylinder head cover and does not leak outside, and therefore it is possible to simplify the structure of preventing oil from leaking outside the oil control valve.

BRIEF DESCRIPTION OF DRAWINGS

FIG. 10(*b*) is a partially enlarged detailed view of FIG. 10(*a*).

FIG. 13 and FIG. 14 are views showing a manner of installing a conventional oil control valve.

DETAILED DESCRIPTION OF THE INVENTION

Embodiment 1.

Figure 1:
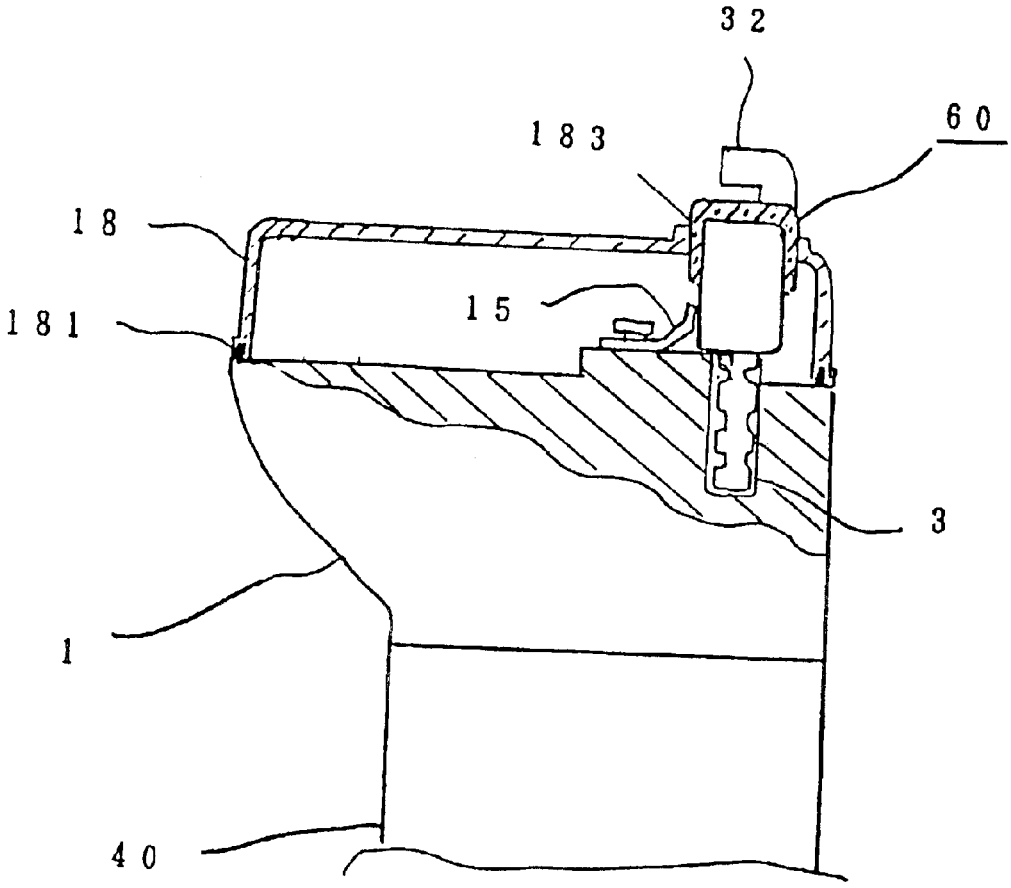
FIG. 1 is a schematic view showing a manner of installing an oil control valve according to Embodiment 1 of the invention on an engine.

FIG. 1 shows a manner of installing an oil control valve (OCV) according to the invention. In the drawing, numeral 40 is a cylinder block of an engine, numeral 1 is a cylinder head mounted on an upper portion of the cylinder block 40, and numeral 18 is a cylinder head cover (head cover) mounted on an upper portion of the cylinder head 1. The head cover 18 is sealed with an oil seal 181 in order to prevent an oil leakage.

Numeral 60 shows the OCV according to Embodiment 1, and the OCV passing through the head cover 18 is mounted onto the upper portion of the cylinder head 1 with a mounting leg 15. A through hole 183 is provided through the head cover 18 as a matter of course.

Figure 2:
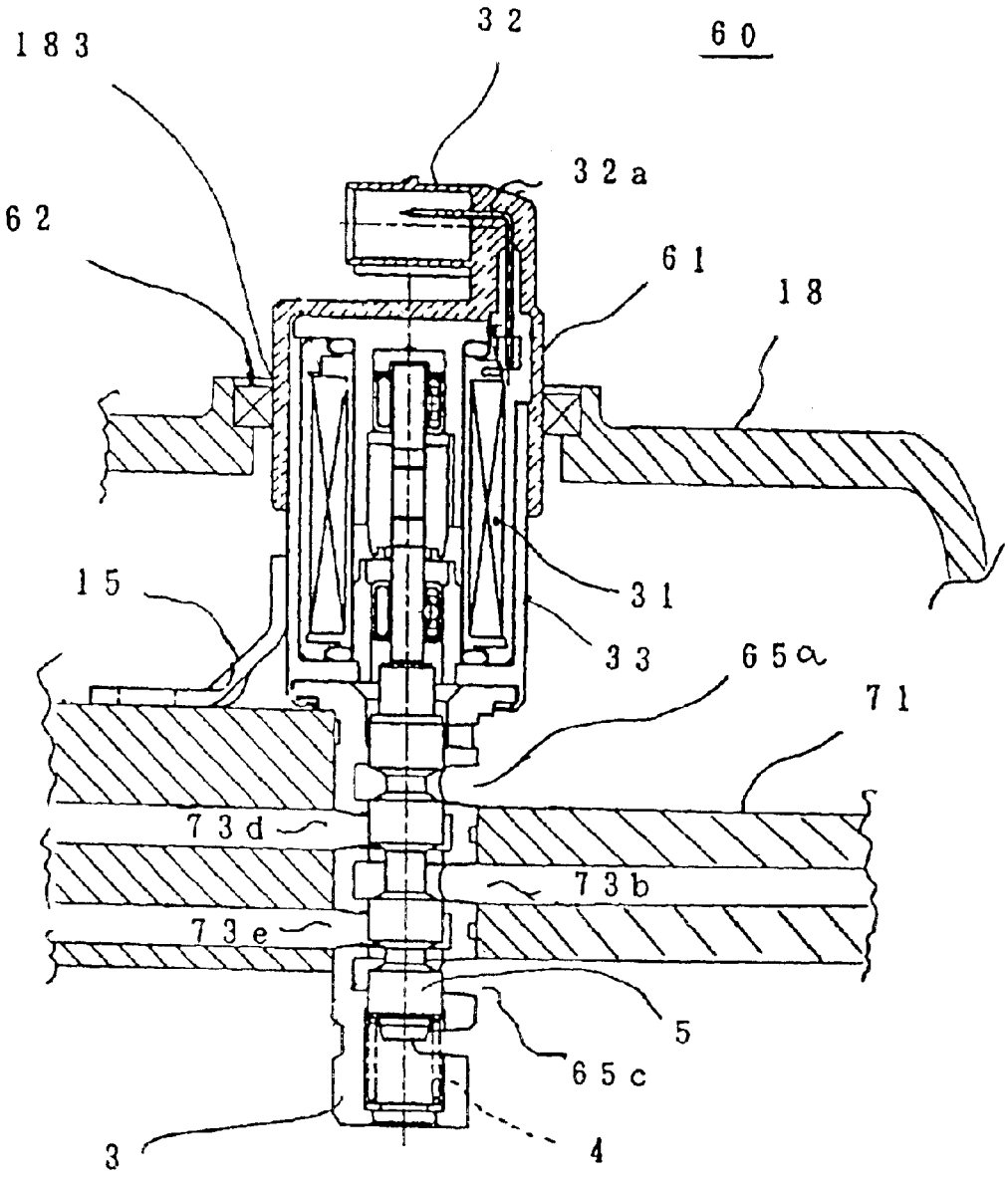
FIG. 2 is a partially enlarged sectional view of FIG. 1.

FIG. 2 shows the structure and the installing method of the OCV 60 in FIG. 1 in detail. In the drawing, numeral 61 is a plastic seal cover tightly fitted on the outside of a metal case 33 covering a solenoid 31 of the OCV 60, and the seal cover 61 is cylindrical in shape. Numeral 62 is an oil seal disposed on the inner wall face of the through hole 183 of the head cover 18. A connector 32 is disposed so as not to protrude out of the external diameter of the cylinder of the seal cover 61, and is airtight inside.

In general, there is a possibility that the head cover 18 is displaced by several millimeters (in horizontal direction and in vertical direction in FIG. 2) at the time of installing the head cover 18. Therefore an oil seal capable of absorbing such displacement and sealing is employed as the oil seal 62.

Figure 3:
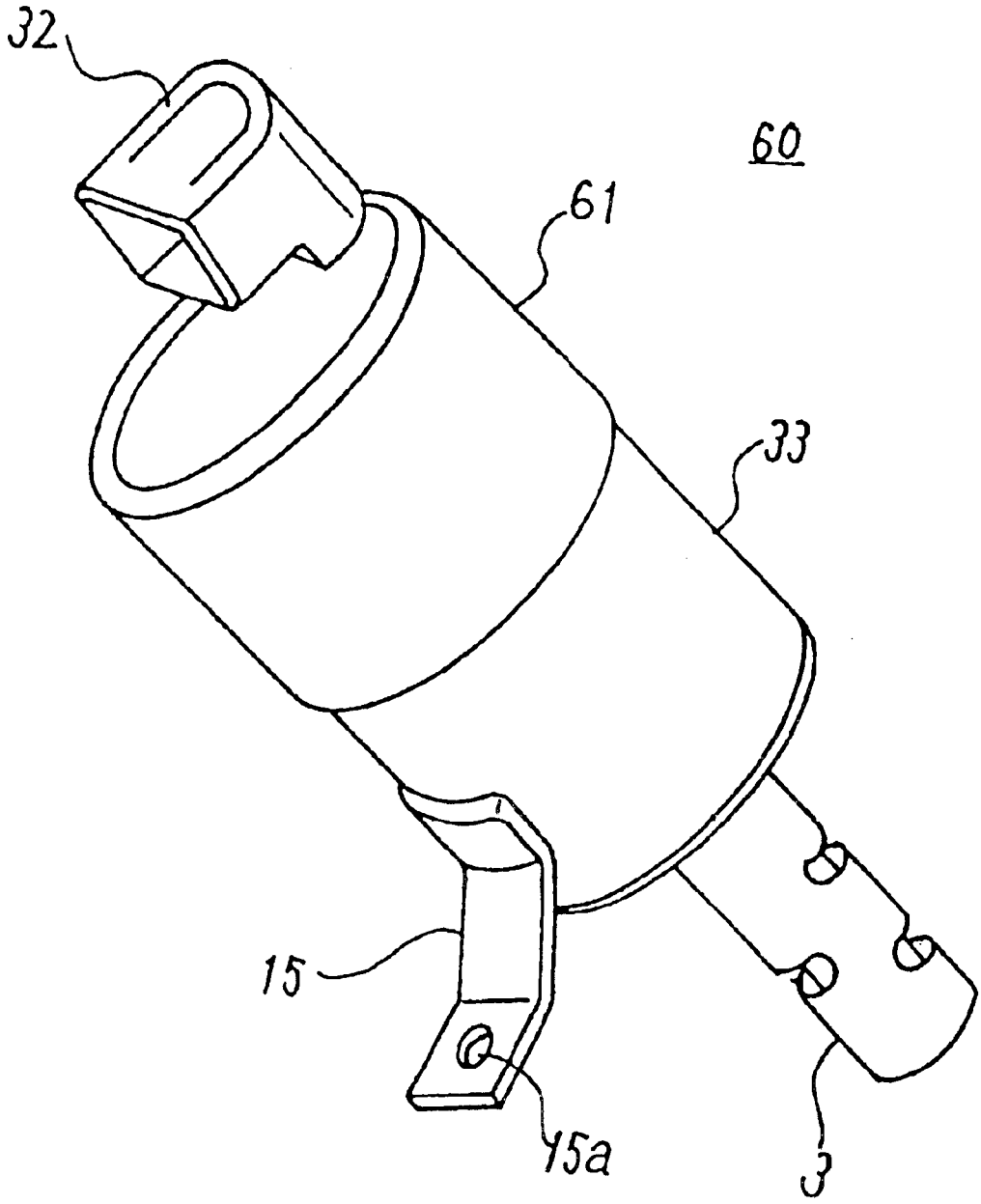
FIG. 3 is a perspective view showing an external appearance of the oil control valve in FIG. 1.

For better understanding, FIG. 3 shows a perspective external appearance of the OCV 60. In FIG. 3, numeral 15 is the mounting leg of L-shape (serving as a reinforcing portion inclined to a surface of the metal case 33) formed by bending a thick plate of approximately 2 to 3 mm in thickness twice at 45 degrees. The fixing leg 15 is designed to facilitate installation with the center of a bolt fitting hole 15*a* sufficiently spaced away from the surface of the metal case 33 (so that a space may be secured for inserting a spanner, for example). The fixing leg 15 is welded to the metal case 33. Numeral 71 in FIG. 2 is dedicated cam cap obtained by working on plural oil lines of the OCV 60.

The inside of the head cover 18 serves as an oil line drain itself, and therefore uppermost drain line 65*a* and lowermost drain line 65*c* in the OCV 60 are opened to the space without providing any oil line in the cam cap 71.

The seal cover 61 is tightly fitted on the metal case 33 and the connector 32 is also airtight, and therefore oil never leaks out of the head cover 18 through inside of the OCV 60.

Figure 15:
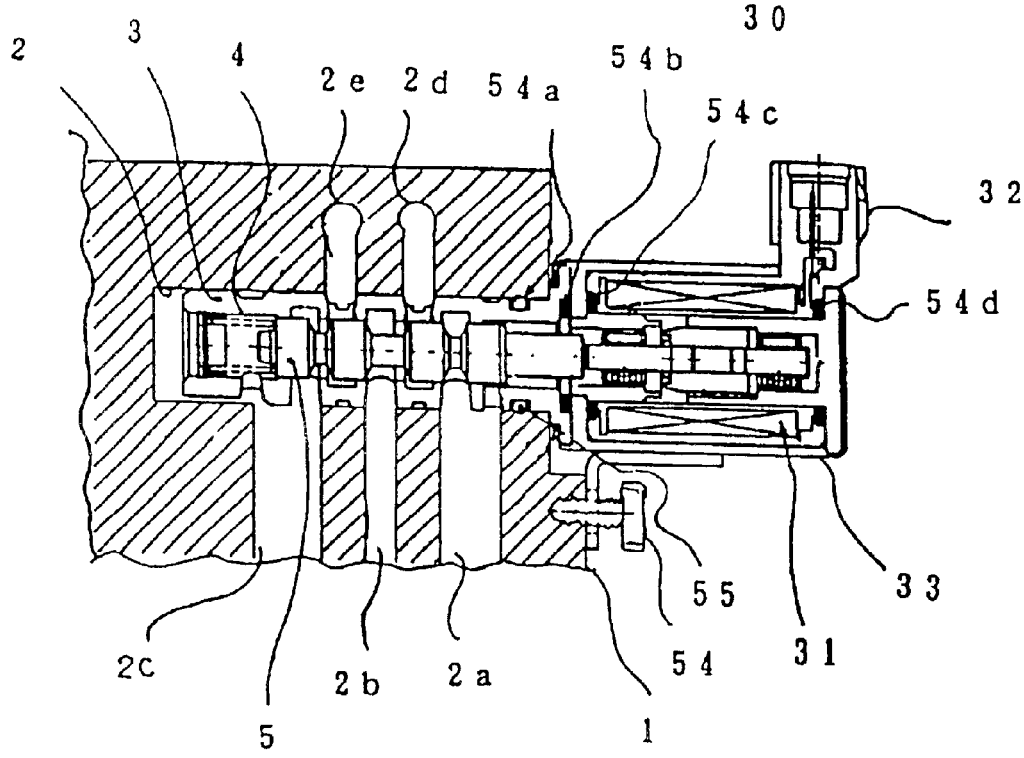
(RELATED ART) FIG. 15
FIG. 15 is a sectional view of the conventional oil control valve.

As described above, since the inside of the head cover 18 serves as the oil line drain, there may be a small amount of oil leakage in the head cover 18 through clearance of the housing 3 and the case 33. This, however, does not cause any problem as long as original oil pressure is not lowered due to the oil leak, and it is therefore necessary to dispose the first and second O-rings 54*a* and 54*b* used in the conventional oil control valve shown in FIG. 15.

Third O-rings 54*c* and 54*d* are not necessary in view of preventing an oil leakage, but those third O rings are not omitted herein in view of maintaining smooth movement of the spool type valve 5 and backing it up.

The connector 32 is disposed in the direction crossing the axis of the solenoid at an approximately right angle so that the connector 32 may be in parallel to the upper face of the head cover 18. This prevents troubles such as interference with the rear face of the bon-net.

Figure 4:
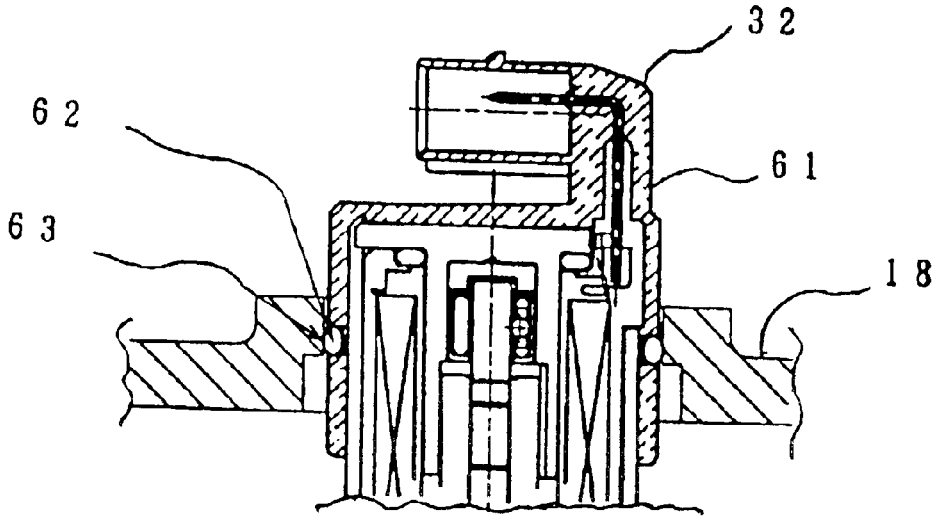
FIG. 4 is a view showing a modification of the oil control valve in FIG. 2.

In the foregoing description, the oil seal 62 disposed around the solenoid 31 is fitted to the head cover 18 side in FIG. 2, and it is also preferable that the oil seal 62 is fitted to the seal cover 61 side as a matter of course. It is also preferable that the oil seal 62 is fitted to the both sides. In effect, it is required to dispose the oil seal between an outer circumferential face of the seal cover 61 and an inner wall face of the through hole of the cylinder head cover 18. FIG. 4 shows an example of fitting the oil seal 62 such as an O ring in a groove 63 formed on an outer circumference of the seal cover 61.

Figure 5:
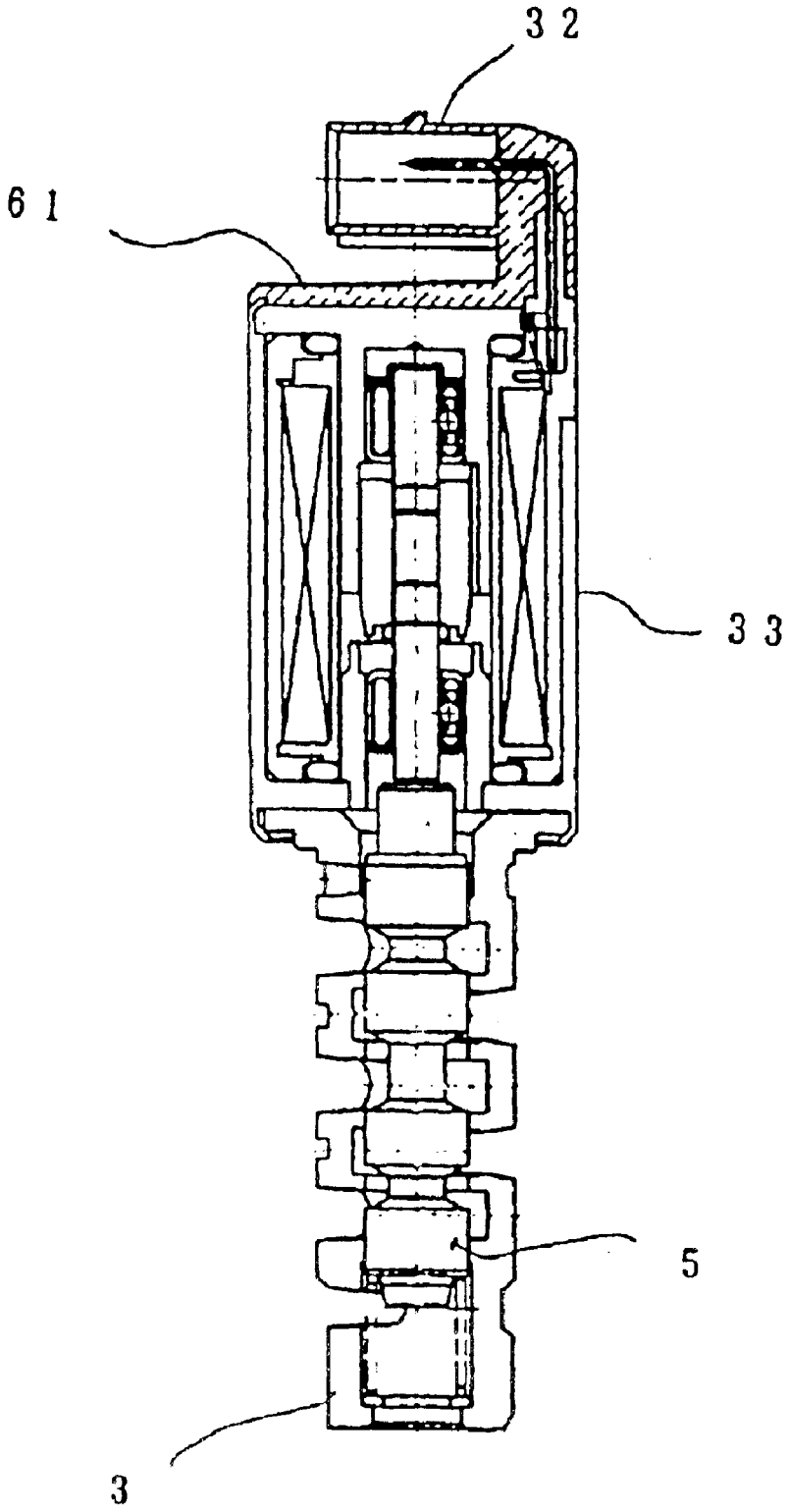
FIG. 5 is a view showing another modification of the oil control valve in FIG. 2.

The seal cover 61 is disposed in order to improve efficiency in oil sealing. Therefore the seal cover 61 is not always necessary if the surface of the metal case 33 is smooth and there is no possibility of oil leakage out of the connector 32 and the solenoid 31. FIG. 5 shows an example of the seal cover 61 disposed only on the headportion of the OCV.

Embodiment 2.

Figure 6:
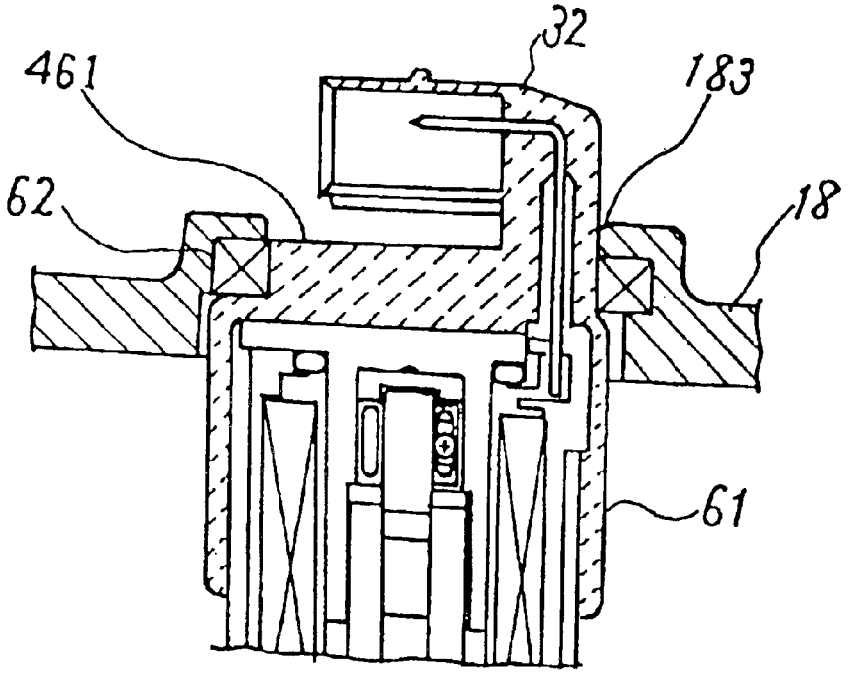
FIG. 6 is a sectional view of an oil control valve according to Embodiment 2 of the invention.

FIG. 6 shows a partially detailed view of the structure of the OCV according to Embodiment 2.

In the drawing, numeral 461 is a seal portion disposed on the head portion of the seal cover 61, and the seal portion 461 is cylindrical and prevents oil leakage with the oil seal 62 tightly fitted on the seal portion 461.

Figure 7:
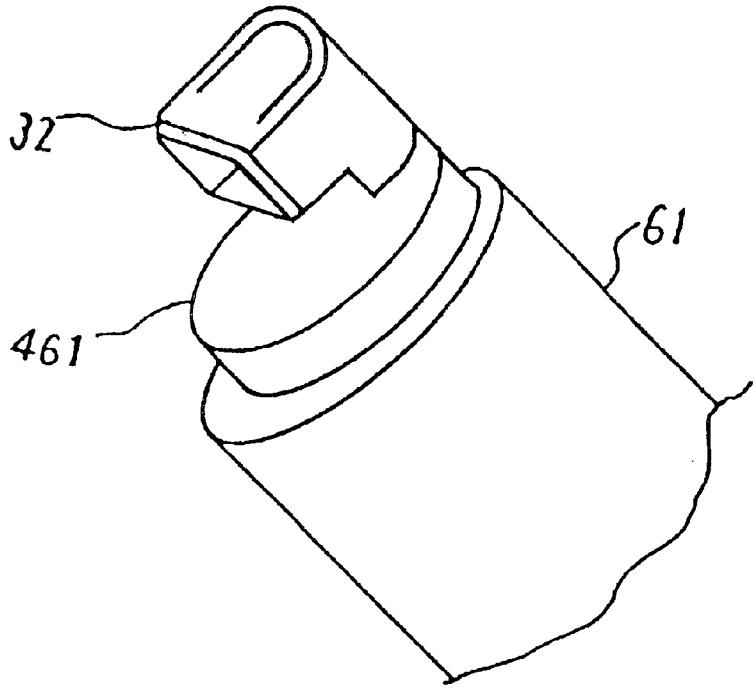
FIG. 7 is a perspective view showing an external appearance of the oil control valve in FIG. 6.

For better understanding, FIG. 7 is a perspective view of FIG. 6 showing an external appearance. The head cover 18 is omitted.

The seal portion 461 is not always required to be concentric with the seal cover 61. However, to apply an electric current to the solenoid 31, it is necessary that the connector 32 be within the diameter of the seal portion 461 so that the connector 32 may pass through the through hole 183 of the head cover 18.

It is possible to further reduce the possibility of oil leakage by integrally forming the connector 32 and the seal cover 61.

Embodiment 3.

Figure 8:
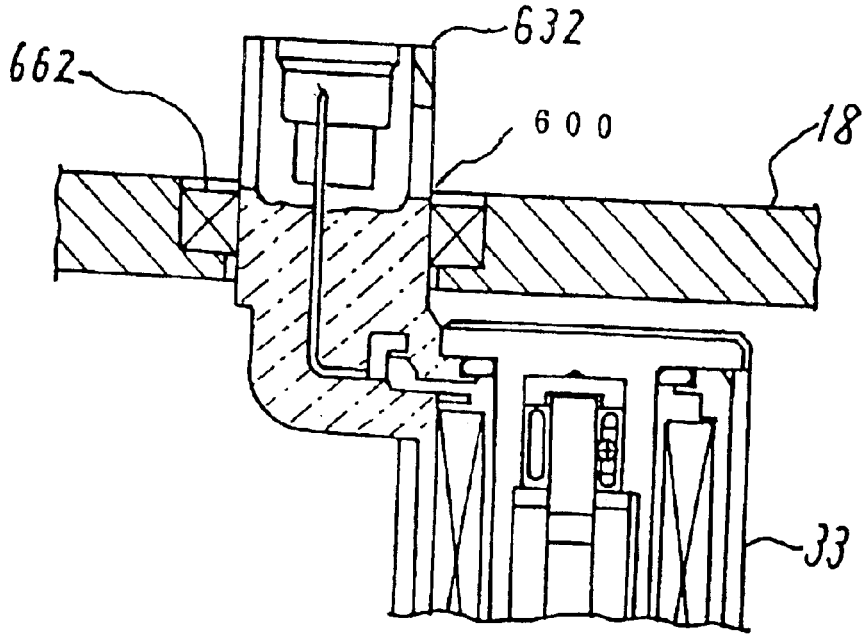
FIG. 8 is a sectional view of an oil control valve according to Embodiment 3 of the invention.

FIG. 8 shows a partial detailed view of the structure of the oil control valve according to Embodiment 3.

In the drawing, numeral 632 is a connector that is cylindrical in external appearance, and the connector 632 is sealed with a connector oil seal 662 disposed on the head cover 18 side in order to seal oil inside. As compared with the construction of FIG. 2 in Embodiment 1, the oil seal 662 can be small in diameter, and therefore oil is sealed in more easily. The housing 3 of the OCV is mounted on the cam cap 71.

The cylindrical connector 632 is of waterproof and oil-proof structure, and the connector is air-tightly sealed inside as a matter of course.

Figure 9:
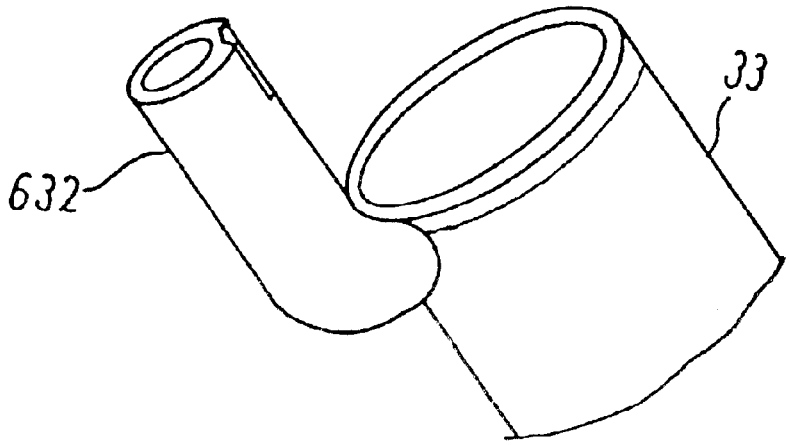
FIG. 9 is a perspective view showing an external appearance of the oil control valve in FIG. 8.

FIG. 9 shows a perspective view of the external appearance of the OCV in FIG. 8.

The head cover 18 is not shown in FIG. 9. Although it is not shown in detail in the drawing, a key for preventing the cylindrical connector 632 from getting out does not protrude out of the diameter of the cylindrical portion of the connector but remains within the diameter. In addition, the cylindrical connector 632 is connected to a side face of the OCV in the drawing, and it is also preferable that the connector 632 is disposed at the head portion as a matter of course. It is essential that at least a part of the connector 632 passes through a through hole 600 of the cylinder head cover 18.

Embodiment 4.

In FIG. 2 showing Embodiment 1, there is a possibility that oil having entered through a contact face between the seal cover 61 and the metal case 33, leaks to outside through a space between the connector 32 and a terminal 32*a* in the connector 32. A structure for preventing such oil leakage is shown in FIGS. 10 (*a*) and (*b*).

Figure 10A:
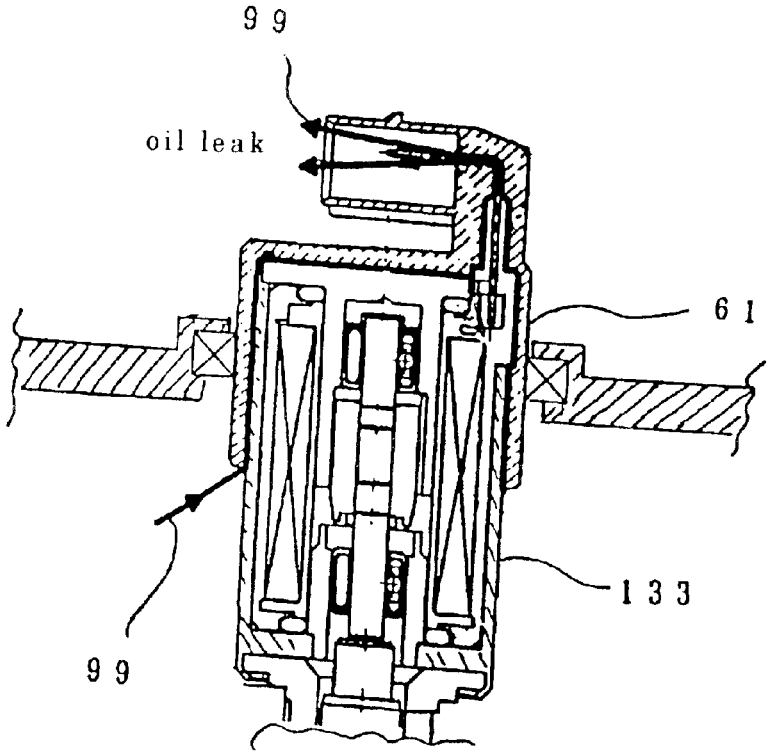
FIG. 10(*a*) is a sectional view of an oil control valve according to Embodiment 4 of the invention.
Figure 10B:
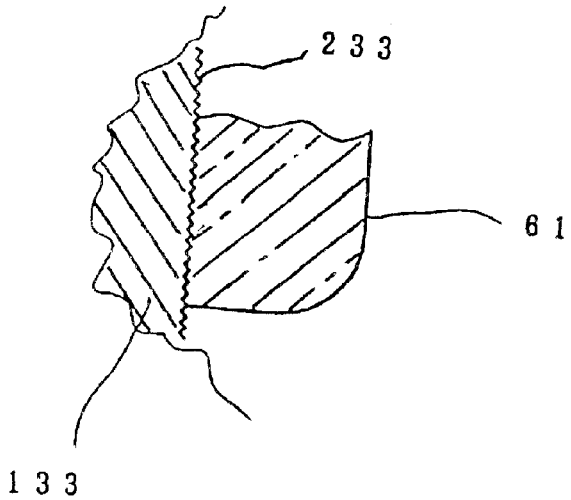

On the surface of a metal case 133 in FIG. 10 (*a*), a corrugated face 233 with its corrugation formed circumferentially is arranged as shown in the partially enlarged view of FIG. 10 (*b*). The corrugation 233 is approximately in the range of 0.01 to 0.1 mm both in wavelength and in wave height. Numeral 99 shows an oil admission passage indicated by the thick solid line for convenience of explanation.

As a result of providing such corrugated face 233, the plastic seal cover 61 fits more tightly on a surface of the metal case 133, and it is possible to prevent penetration of water and oil. The corrugated face 233 is formed at least on a part of an outer circumferential face of the metal case 133, and the corrugated face 233 serves as the means for sealing oil inside in this invention. It is also preferable to apply a sealing agent to a part of this oil admission passage.

Embodiment 5.

Figure 11:
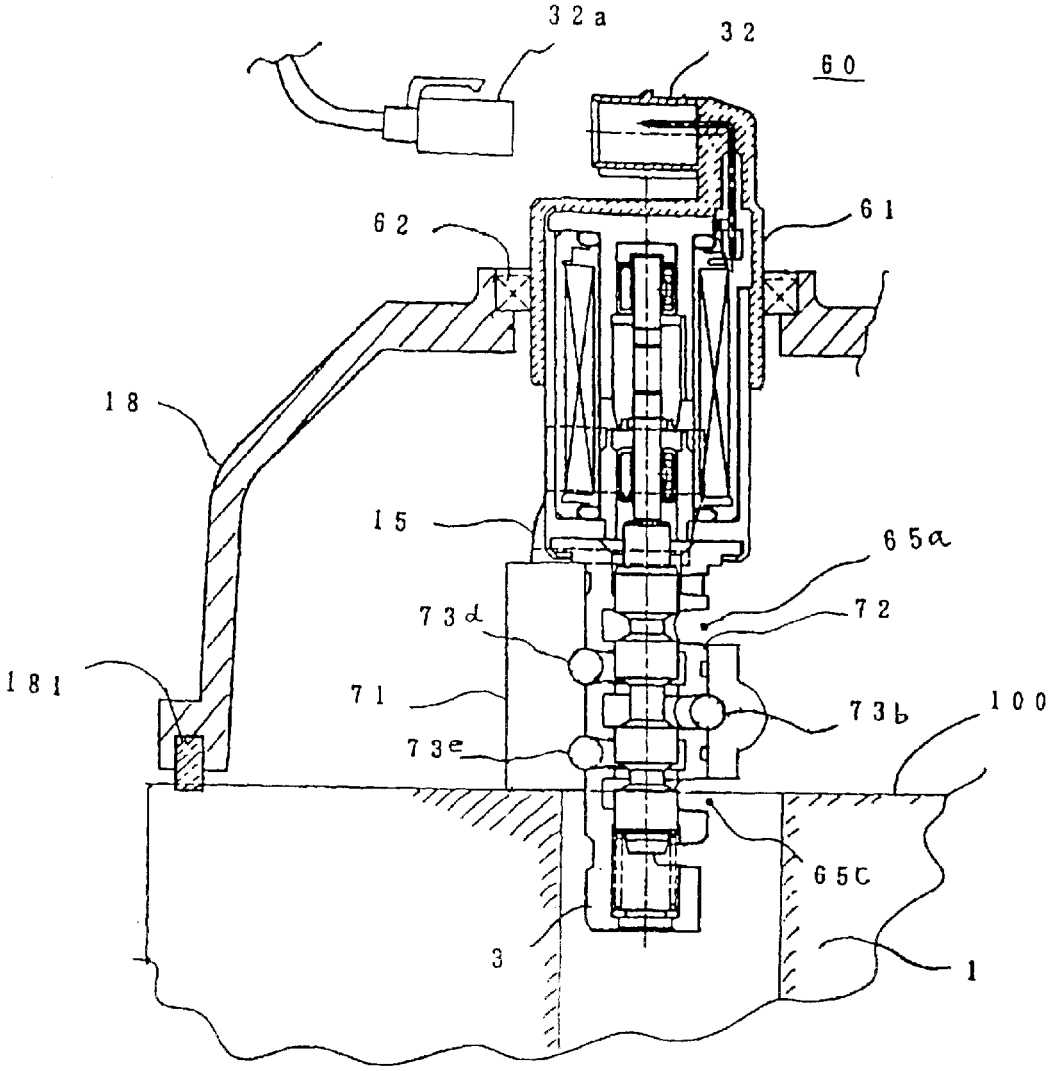
FIG. 11 is a view for explaining a method of installing an oil control valve according to Embodiment 5 of the invention.

FIG. 11 shows a more effective method of installing the OCV according to the invention.

In the drawing, numeral 1 is a cylinder head, numeral 100 is an upper face of the cylinder head 1, numeral 18 is a head cover mounted on the upper portion of the cylinder head 1, and numeral 60 is an OCV.

Numeral 71 is a cam cap mounted on the upper portion 100 of the cylinder head 1 with a bolt not shown, and a variable valve timing gear 20 is mounted on a camshaft not shown in the vicinity thereof. As described in the foregoing description of the background art, the cam cap forms a bearing of the camshaft not shown in the drawing. Numeral 72 is a housing installation hole provided on the cam cap 71.

Numeral 73*b* is an oil line provided in the cam cap 71, and communicates to an oil pump not shown through inside of the cylinder head 1 not shown.

Numerals 73*d* and 73*e* are oil lines provided in the cam cap 71, and communicate to the variable valve timing gear not shown through inside of the camshaft not shown.

The oil lines 73*b*, 73*d*, and 73*e* are formed before mounting the cam cap 71 on the cylinder head 1. Numerals 65*a* and 65*c* are drain lines provided on the housing 3, and the drain lines 65*a* and 65*c* are opened to the space without providing any oil line on the cam cap 71.

The OCV 60 is bolted on the cam cap 71 with a fixing leg 15.

Figure 12:
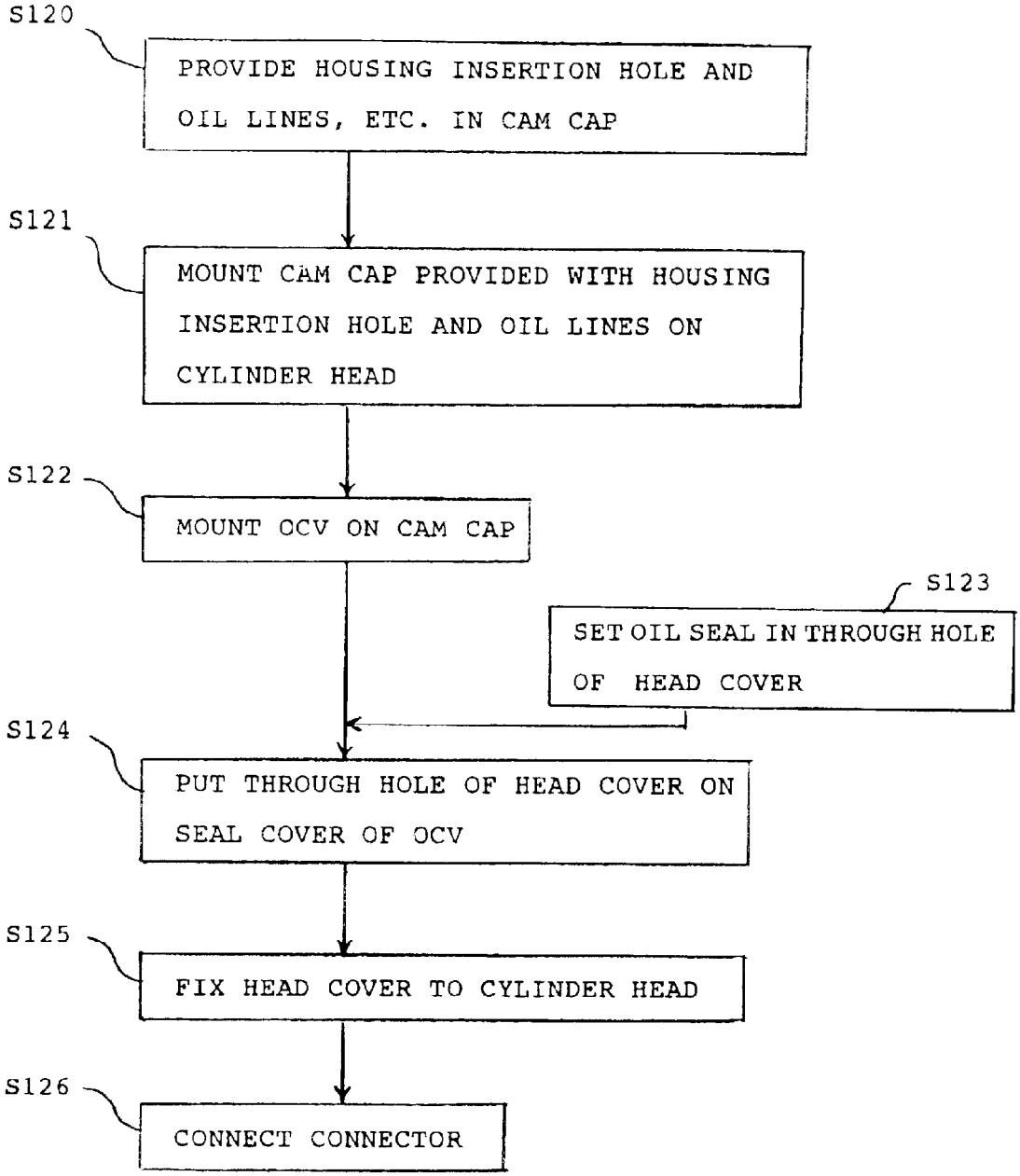
FIG. 12 is a flowchart explaining the installing method of FIG. 11.

The OCV 60 is mounted on the engine according to an assembling procedure shown in the flowchart in FIG. 12. First, in step S120, the housing installation hole 72 and the oil lines 73*b* to 73*e* are preliminarily provided in the cam cap 71 in advance.

In step S121, the cam cap 71 is mounted on the cylinder head 1. (Although it is not shown in the drawing, mounting the cam cap 71 means that the camshaft and the variable valve-timing gear 20 are also mounted.)

In step S122, the housing 3 of the OCV is inserted in the housing installation hole of the cam cap and is mounted on the cam cap 71.

In step S123, the oil seal 62 and the head oil seal 181 are set in the head cover 18.

In step S124, the head cover 18 is put on while protruding the head portion of the OCV from the through hole of the head cover 18, and in step S125, the head cover is fixed onto the cylinder head.

Instep S126, wiring (a connector) of an engine control unit is connected to the connector 32.

In the method of installing the OCV shown in FIGS. 11 and 12, several advantages are performed such that the oil lines between the OCV and the variable valve timing gear disposed at the end of the camshaft not shown are processed in the cam cap 71, and the drain line 65 becomes an open route and does not need any particular work. Consequently, it becomes possible to simplify the installation structure.

In the case that the variable valve timing gear is disposed on both intake side and exhaust side of the engine, which is not described in particular in the foregoing description, it is preferable that each OCV is mounted on the cam cap of each camshaft. It is also preferable that the variable valve timing gear is mounted on an intake-exhaust cam cap.

INDUSTRIAL APPLICABILITY

The oil control valve and an installing method thereof according to present invention is applicable not only to engines for vehicles but also to internal combustion engines in general provided with variable valve timing gears.

What is claimed is:

1. An oil control valve that controls a variable valve timing gear for adjusting operation timing of at least one of exhaust and intake camshafts mounted on a cylinder head of an internal combustion engine, comprising:

a housing provided with plural oil lines;

a spool type valve that moves in said housing to open and close said oil lines; and a solenoid having a metal case that forms a part of a magnetic circuit and driving said spool type valve, wherein said housing is mounted on the cylinder head of said internal combustion engine, and at least a part of said metal case passing through a through hole provided through a cylinder head cover covering said cylinder head is disposed outside said cylinder head cover; and said plural oil lines comprise an uppermost drain line opened to the metal case.

2. The oil control valve according to claim 1, further comprising a cylindrical seal cover for covering at least a part of an outside of the metal case, and an oil seal between an outer circumferential face of said seal cover and an inner wall face of the through hole of said cylinder head cover.

3. The oil control valve according to claim 2, further comprising oil sealing means for sealing oil formed with a corrugated face is disposed in at least a part of the outer circumferential face of the metal case where said metal case is in contact with the seal cover.

4. The oil control valve according to claim 2, wherein the seal cover is integrally formed with a connector for applying an electric current to the solenoid within an external diameter of said seal cover.

5. The oil control valve according to claim 4, wherein the connector is inserted in a direction crossing an axial direction of the solenoid at an approximately right angle.

6. An oil control valve that controls a variable valve timing gear for adjusting operation timing of at least one of exhaust and intake camshafts mounted on a cylinder head of an internal combustion engine, comprising:

a housing provided with plural oil lines;

a spool type valve that moves in said housing to open and close the oil lines; and a solenoid having a metal case that forms a part of a magnetic circuit, and being in contact with an end of said spool type valve, drives said spool type valve; and a connector disposed on an outside of said solenoid on a side where the solenoid is not in contact with the spool type valve;

wherein said housing is mounted on said cylinder head of the internal combustion engine, and at least a part of said connector passing through a through hole provided through a cylinder head cover covering the cylinder head is disposed outside said cylinder head cover.

7. The oil control valve according to claim 6, wherein the metal case comprises a fixing leg welded to a side face of said metal case and having a reinforcing portion inclined to a surface of said metal case.

8. An installing method for installing an oil control valve including the steps of:

providing preliminarily a housing installation hole in a cam cap serving as a bearing of a camshaft;

installing said cam cap on a cylinder head;

inserting and installing a housing of the oil control valve in the housing installation hole of said cam cap; and installing a cylinder head cover by passing at least a part of the oil control valve through a through hole of a cylinder head cover after installing said oil control valve.

9. The oil control valve according to claim 1, wherein the metal case comprises a fixing leg welded to a side face of said metal case and having a reinforcing portion inclined to a surface of said metal case.

10. An oil control valve that controls a variable valve timing gear for adjusting operation timing of at least one of exhaust and intake camshafts mounted on a cylinder head of an internal combustion engine, comprising:

a housing provided with plural oil lines;

a spool type valve that moves in said housing to open and close said oil lines; and a solenoid having a metal case that forms a part of a magnetic circuit and driving said spool type valve, wherein said housing is mounted on the cylinder head of said internal combustion engine, and at least a part of said metal case passing through a through hole provided through a cylinder head cover covering said cylinder head is disposed outside said cylinder head cover, said oil control valve further comprising a cylindrical seal cover for covering at least a part of an outside of the metal case, and an oil seal between an outer circumferential face of said seal cover and an inner wall face of the through hole of said cylinder head cover.

11. The oil control valve according to claim 10, further comprising oil sealing means for sealing oil formed with a corrugated face is disposed in at least a part of the outer circumferential face of the metal case where said metal case is in contact with the seal cover.

12. The oil control valve according to claim 10, wherein the seal cover is integrally formed with a connector for applying an electric current to the solenoid within an external diameter of said seal cover.

13. The oil control valve according to claim 12, wherein the connector is inserted in a direction crossing an axial direction of the solenoid at an approximately right angle.

14. An oil control valve that controls a variable valve timing gear for adjusting operation timing of at least one of exhaust and intake camshafts mounted on a cylinder head of an internal combustion engine, comprising:

a housing provided with plural oil lines;

a spool type valve that moves in said housing to open and close said oil lines; and a solenoid having a metal case that forms a part of a magnetic circuit and driving said spool type valve, wherein said housing is mounted on the cylinder head of said internal combustion engine, and at least a part of said metal case passing through a through hole provided through a cylinder head cover covering said cylinder head is disposed outside said cylinder head cover; and the metal case comprises a fixing leg welded to a side face of said metal case and having a reinforcing portion inclined to a surface of said metal case.

15. The oil control valve according to claim 2, wherein the cylindrical seal cover continuously covers both the outer circumferential surface and the axially outer end face of the metal case at the through hole of said cylinder head cover.

16. The oil control valve according to claim 15, wherein, along the transition from the outer circumferential surface to the axially outer end face of the metal case, the seal portion comprises a stepback so that an axially outer portion is of a smaller diameter than the portion covering the outer circumferential surface of the metal case.

17. The oil control valve according to claim 10, wherein the cylindrical seal cover continuously covers both the outer circumferential surface and the axially outer end face of the metal case at the through hole of said cylinder head cover.

18. The oil control valve according to claim 17, wherein, along the transition from the outer circumferential surface to the axially outer end face of the metal case, the seal portion comprises a stepback so that an axially outer portion is of a smaller diameter than the portion covering the outer circumferential surface of the metal case.

19. The oil control valve according to claim 4, wherein the connector is formed on an outer peripheral portion of the seal cover on an axial end face of the metal case.

20. The oil control valve according to claim 12, wherein the connector is formed on an outer peripheral portion of the seal cover on an axial end face of the metal case.

21. The oil control valve according to claim 6, wherein an entirety of the metal case is disposed within the cylinder head cover.

22. The oil control valve according to claim 6, wherein the connector extends along an axis parallel but offset to the axis upon which the metal case and spool type valve extend.

23. The oil control valve according to claim 6, wherein the connector extends from an axial end face of the metal case.

24. The oil control valve according to claim 6, wherein the connector extends from a circumferential side of the metal case near its axial end face.

25. The installing method for installing an oil control valve according to claim 8, further comprising, before installing the cylinder head cover, arranging an oil seal in the through hole of the cylinder head cover.

26. The installing method for installing an oil control valve according to claim 8, further comprising, after installing the cylinder head cover, connecting a lead to a connector on the portion of the oil control valve that extends out of the through hole of the cylinder head cover.

27. An oil control valve that controls a variable valve timing gear for adjusting operation timing of at least one of exhaust and intake camshafts mounted on a cylinder head of an internal combustion engine, comprising:

a housing provided with plural oil lines;

a spool type valve that moves in said housing to open and close said oil lines; and a solenoid having a metal case that forms a part of a magnetic circuit and driving said spool type valve, wherein said housing is mounted on the cylinder head of said internal combustion engine, and at least a part of said metal case passing through a through hole provided through a cylinder head cover covering said cylinder head is disposed outside said cylinder head cover, said oil control valve further comprising a cylindrical seal cover for covering at least a part of an outside of the metal case between an outer circumferential face of the metal case and an inner wall face of the through hole of said cylinder head cover.

* * * * *